United States Patent [19]

Karlsson et al.

[11] 4,399,878

[45] Aug. 23, 1983

[54] LUBRICATING DEVICE

[75] Inventors: Harry L. Karlsson, Sandviken; Lars G. Norlander, Surte, both of Sweden

[73] Assignees: Sandvik Aktiebolag, Sandviken; Aktiebolaget SKF, Göteborg, both of Sweden

[21] Appl. No.: 293,710

[22] Filed: Aug. 18, 1981

[30] Foreign Application Priority Data

Sep. 26, 1980 [SE] Sweden ..... 8006734

[51] Int. Cl.[3] ..... E21B 10/22

[52] U.S. Cl. ..... 175/227; 384/93; 184/55 A

[58] Field of Search ..... 184/55 R, 55 A; 175/227, 228, 229, 337; 308/8.2; 384/93

[56] References Cited

U.S. PATENT DOCUMENTS

| | | | |
|---|---|---|---|
| 2,515,417 | 7/1950 | Myers | 184/55 A |
| 2,767,807 | 10/1956 | Booth | 184/55 A |
| 2,831,660 | 4/1958 | Smiecinski | 175/228 |
| 4,280,571 | 7/1981 | Fuller | 308/8.2 |

*Primary Examiner*—Ernest R. Purser
*Assistant Examiner*—Joseph Falk
*Attorney, Agent, or Firm*—Burns, Doane, Swecker & Mathis

[57] ABSTRACT

A device for lubricating rotary drill bits of the type comprising a roller cutter (14) which is rotatably carried by means of a bearing system (15, 16, 17, 18). Fluid is supplied to the bearing system for cooling and/or cleaning thereof through a passage (31, 32, 33; 51, 61), and a lubricant is delivered to said passage from a body (31; 39) of porous material, which is soaked in lubricating means. For purposes of controlling the supply of lubricating means the porous member forms a fraction of the inner wall of said passage.

7 Claims, 3 Drawing Figures

LUBRICATING DEVICE

The present invention relates to a device for lubricating rotary drill bits of the type comprising at least one roller cutter provided with cutting means which is rotatably carried by means of a bearing system. The drill bit is provided with at least one first passage means for supplying flushing fluid to the hole drilled by the drill bit, and at least one second passage means for supplying fluid to the bearing system for cooling thereof. Lubricating means is supplied to the fluid in the second passage means for simultaneous lubricating of the bearing system.

The bearing systems in rotary drill bits are designed either sealed or unsealed. A sealed design means that the bearing system is sealed and supplied with a lubricant, such as grease or oil, from a reservoir which is built-in inside the drill bit. The lubricant is supplied to the bearing system by means of the difference in pressure inside and outside thereof via a membrane. No air or other cooling medium is supplied to the bearing system. An unsealed design, of which the present invention is an example, means that the bearing system has no sealing means. Impurities are prevented from entering into the bearing system due to the fact that air is supplied thereto, which air flows outwards for forming an air barrier between the roller cutter and the leg associated therewith.

For purposes of lubricating the bearing system it has been proposed to deliver lubricant means to solely that portion of the air which is supplied to the bearing system for cooling and cleaning thereof. U.S. Pat. No. 2,831,660 discloses a design in which a lubricant reservoir is arranged in each of the legs of the drill bit, and the lubricant is delivered to the cooling air through a passage in the leg. U.S. Pat. No. 3,220,496 discloses a design in which lubricant is delivered to the bearing system from an adapter which is mounted between the drill bit and the forward end of the drill string. The pressure of the flushing fluid forces the lubricant to the bearing system via a piston. A similar design is disclosed in U.S. Pat. No. 3,749,186.

A disadvantage of the above-mentioned previously known lubricating devices is that the supply of lubricant from the reservoir has been difficult to control, which means that too much lubricant often has been supplied during the first phase of the drilling operation with the result that all lubricant is consumed in a later phase of the drilling operation, which decreases the life of the drill bit.

An object of the present invention is to provide a rotary drill bit in which the supply of lubricant can be kept on a predetermined and controlled level, thereby making it possible to increase the life of the drill bit. Another object of the invention is to provide a rotary drill bit in which the risk for break downs is small, thereby increasing the reliability of the drill bit. These and other objects are attained by giving the invention the characterizing features stated in the appending claims.

The invention is described in detail in the following with reference to the accompanying drawings in which two embodiments are shown by way of example.

It is to be understood that these embodiments are only illustrative of the invention and that various modifications thereof may be made within the scope of the claims.

In the drawings.

In the drawings corresponding details on the two embodiments have been given the same reference numeral.

Figures 1, 2:
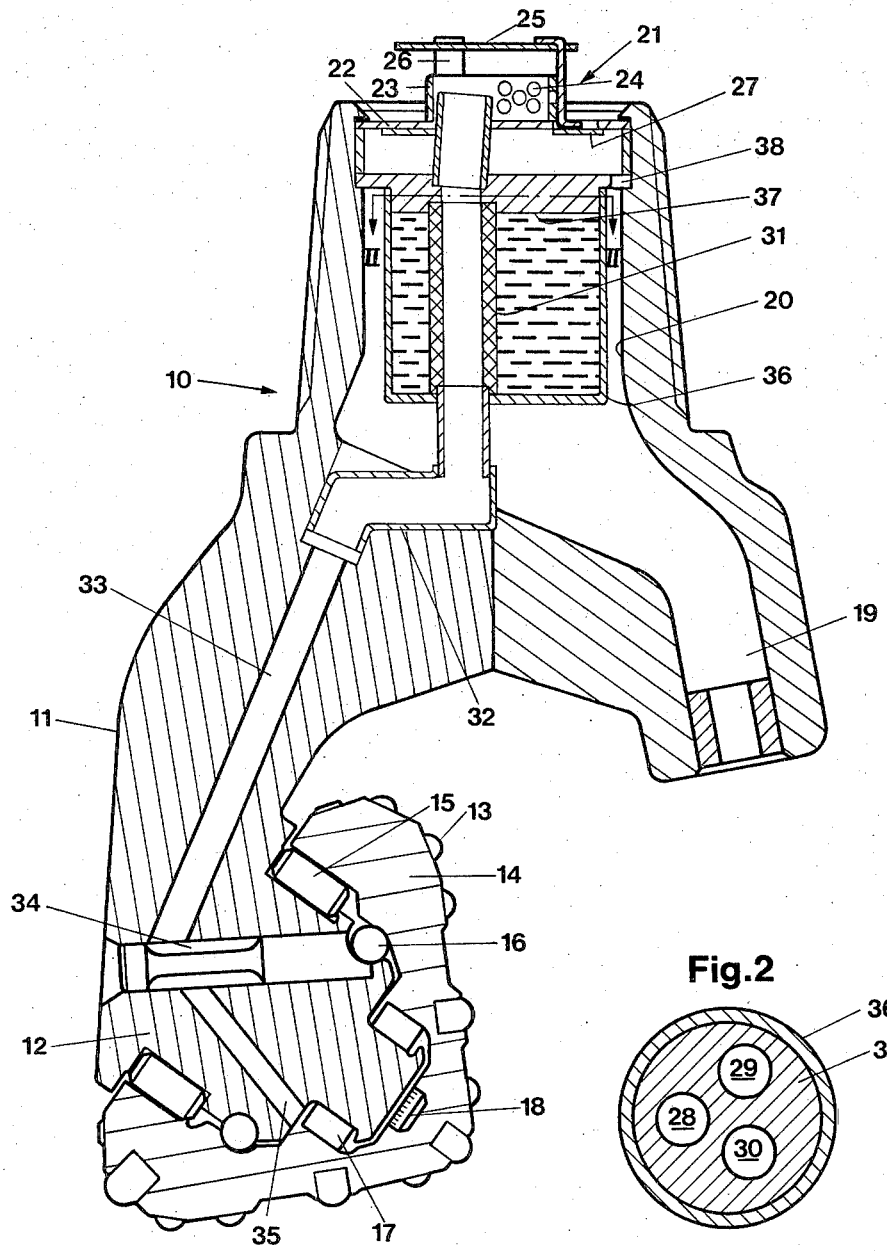
FIG. 1 shows a sectional view of a rotary drill bit having a lubricating device according to the invention.
FIG. 2 shows a section taken on the line II—II in FIG. 1.

In FIG. 1 a rotary rock drill bit 10 is shown having a support leg 11 on which a support or bearing pin 12 is provided. A roller cutter 14 is in conventional manner rotatably journalled on the bearing pin 12 over a bearing system, which comprises a roller bearing 15, a ball bearing 16, a roller bearing 17 and an axial thrust bearing 18. The roller cutter 14 is provided with cutting means in form of hard metal inserts 13. The drill bit 10 has three legs 11 which together with their associated roller cutters 14 are equally circumferentially spaced. For the sake of clarity only one leg is shown in FIG. 1.

The rotary drill bit 10 is provided with a passage 19 for flushing fluid, such as compressed air with water added thereto. The flushing fluid is intended for flushing the hole drilled by the drill bit. Rearwardly the passage 19 turns into a bore 20. A check valve generally denoted by 21 is arranged in the rear end of the bore 20. The check valve 21 can be considered as consisting of two cooperating valve members, one of which being composed by a flat valve plate 22 and a cylindrical strainer body 23 attached thereto centrally and coaxially therewith. The mantle surface of the strainer body 23 is provided with round holes 24 to allow throughflow of the flushing fluid. The other valve member forms an insertion which is movable relative to the first valve member and comprises a circular cover 25 supported by three axially extending legs 26. The legs 26 surround the strainer body 23 and are attached to the cover 25 and a bottom ring 27.

The rotary drill bit 10 is provided with three passages 28, 29, 30, one for each leg 11, through which fluid, such as compressed air, is supplied to the bearing system 15, 16, 17, 18. Normally the fluid is supplied to the bearing system on the one hand for cooling thereof, and on the other for cleaning thereof and preventing impurities from entering thereinto through the annular gap between the roller cutter and the bearing pin. In certain cases, however, the fluid might be warmer than the bearing system, which means that its primary function is to clean the bearing system. These passages are designed as an axially extending tube 31, which over a knee-tube 32 turns into a passage 33 in the leg 11 and passages 34, 35 in the bearing pin 12. The rear end of the tube 31 terminates within the strainer body 23.

The function of the check valve 21 is in detail described in U.S. Pat. No. 4,184,554. When flushing fluid containing water reaches the check valve 21 the water is separated therefrom before the fluid enters the tube 31.

A reservoir 36 for a lubricant is arranged within the rotary drill bit 10. The reservoir 36 is rearwardly closed by a cover 37, which attaches the reservoir to the drill bit. The cover 37 is provided with recesses 38 through which the flushing fluid which passes the bottom ring 27 is conducted into the bore 20.

According to the invention a portion of the inner wall of the passages 28, 29, 30 is formed by a member of porous material, which is soaked in lubricant. When the fluid flows past this member small drops of lubricant are brought therewith into the bearing system 15, 16, 17, 18. In the embodiment according to FIG. 1 the porous member consists of the tube 31, which thus provides a fraction of the passage 28.

Suitably, the porous material can be a plastic. It has been found that a plastic of the type ACLACELL (Trade Mark) is suitable. It is believed that other porous materials, such as felt and rubber, can be used.

The amount of lubricant which can be absorbed by the porous material is comparatively limited. For purposes of increasing the available volume of lubricant the tube 31 is arranged within the reservoir 36 in the embodiment according to FIG. 1. Due to the fact that the supply of lubricant is completely depending on the fluid flow through the tube 31 a controlled supply of lubricant is achieved. Further, due to the fact that the lubricant is delivered from the pores in the porous material there is no risk for break downs to occur caused by local clogging of the porous material.

In the illustrated embodiment the tube 31 is arranged to traverse through the portion of the flushing fluid passage formed by the bore 20. In FIG. 1 only one tube 31 is shown. As may be seen in FIG. 2, however, a passage 28, 29, 30 with an accompanying tube 31 is arranged for each of the three legs of the drill bit.

Figure 3:
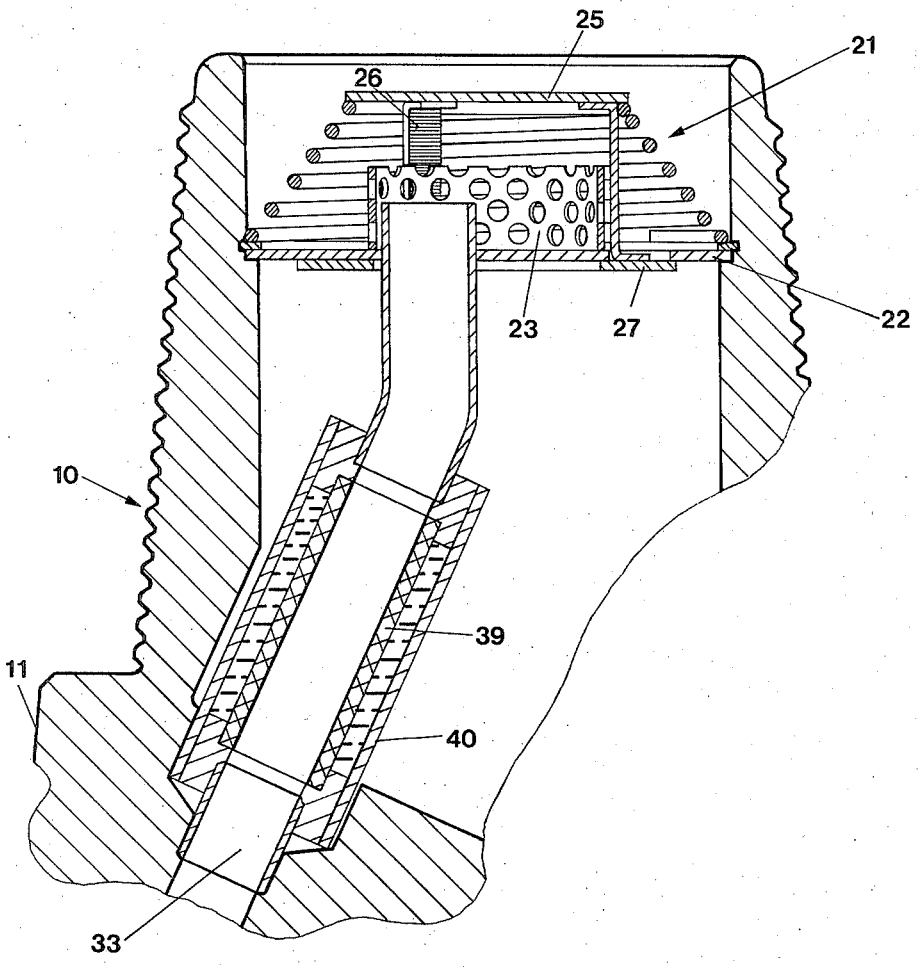
FIG. 3 shows a fractional sectional view of an alternative embodiment of a device according to the invention.

In the embodiment according to FIG. 3 a tube 39 of porous material and a lubricant reservoir 40 are arranged for each of the legs 11 of the drill bit.

In the two illustrated embodiments the lubricant reservoir is accommodated within the drill bit. Alternatively, it is believed that the reservoir could be arranged in an adapter, which is designed for connection between the drill bit and the front end of a drill string which carries the drill bit.

A check valve of the type shown in FIGS. 1 and 3 is then provided in the rear end of the adapter. After the check valve the lubricant reservoir follows, in which a single tube of porous material common for the legs of the drill bit, is located centrally. This adapter is intended to be used together with a drill bit of specific design comprising a rearwardly open catching means of the type shown in U.S. patent application Ser. No. 86,436. Fluid containing lubricant is caught by the catching means and conducted further to the bearing system through a passage in the drill bit via passages in the leg and bearing pin. For a complete description of the function reference is made to the above patent application which therefore is incorporated in the present specification.

We claim:

1. A rotary drill bit comprising:

a support, at least one roller cutter mounted on said support and including cutting means, bearing means disposed in a bearing cavity between said support and said roller cutter, at least one first passage means in said support for supplying flushing fluid to a hole being drilled, at least one reservoir disposed in said support and containing a flowable lubricant, at least one second passage means in said support and communicating with said bearing cavity for conducting fluid thereto, a portion of said second passage means passing through said reservoir upstream of said bearing cavity and being defined by a porous material which communicates with the lubricant in said reservoir to conduct the lubricant into said second passage means.

2. Apparatus according to claim 1, wherein said porous material comprises a tubular member.

3. Apparatus according to claim 2, wherein sections of said first and second passage means coincide and means provided for separating water from the fluid supplied to said second passage means.

4. Apparatus according to claim 2, wherein said at least one roller cutter comprises a plurality of roller cutters, said at least one second passage means comprising a plurality of second passage means corresponding to the number of said roller cutters.

5. Apparatus according to claim 4, wherein at least one reservoir comprises a plurality of reservoirs disposed in respective ones of said second passage means.

6. Apparatus according to claim 4, wherein each of said second passage means communicates with said reservoir.

7. Apparatus according to claim 1, wherein sections of said first and second passage means coincide and contain said reservoir.

* * * * *